US009866960B2

(12) United States Patent
Hashimoto et al.

(10) Patent No.: US 9,866,960 B2
(45) Date of Patent: Jan. 9, 2018

(54) VIBRATION AUDIO SYSTEM, VIBRATION AUDIO OUTPUT METHOD, AND VIBRATION AUDIO PROGRAM

(71) Applicant: CLARION CO., LTD., Saitama-shi (JP)

(72) Inventors: Takeshi Hashimoto, Motomiya (JP); Tetsuo Watanabe, Hasuda (JP); Yasuhiro Fujita, Kashiwa (JP); Kazutomo Fukue, Kitamoto (JP)

(73) Assignee: CLARION CO., LTD., Saitama-Shi (JP)

( * ) Notice: Subject to any disclaimer, the term of this patent is extended or adjusted under 35 U.S.C. 154(b) by 0 days.

(21) Appl. No.: 15/129,827

(22) PCT Filed: Feb. 20, 2015

(86) PCT No.: PCT/JP2015/054716
§ 371 (c)(1),
(2) Date: Sep. 28, 2016

(87) PCT Pub. No.: WO2015/151636
PCT Pub. Date: Oct. 8, 2015

(65) Prior Publication Data

US 2017/0150260 A1 May 25, 2017

(30) Foreign Application Priority Data

Apr. 4, 2014 (JP) ..... 2014-077475

(51) Int. Cl.
*H04R 29/00* (2006.01)
*H04R 3/04* (2006.01)
*H04R 1/02* (2006.01)

(52) U.S. Cl.
CPC ..... *H04R 3/04* (2013.01); *H04R 1/025* (2013.01); *H04R 29/001* (2013.01); *H04R 2201/028* (2013.01)

(58) Field of Classification Search
CPC ..... H04R 3/04; H04R 1/025; H04R 29/001; H04R 2201/028
See application file for complete search history.

(56) References Cited

U.S. PATENT DOCUMENTS 4,354,067 A 10/1982 Yamada et al.
4,495,638 A 1/1985 Yamada et al.
(Continued)

FOREIGN PATENT DOCUMENTS

JP 55-053389 U 4/1980
JP 61-259669 11/1986
(Continued)

OTHER PUBLICATIONS

International Search Report for corresponding International Application No. PCT/JP2015/054716, dated May 12, 2015.
(Continued)

*Primary Examiner* — Regina N Holder
(74) *Attorney, Agent, or Firm* — Mori & Ward, LLP

(57) ABSTRACT

The present invention provides a vibration audio system for transmitting an audio signal outputted from a sound source to a listener in the form of vibration while reducing output level of the signal and power consumption. The system includes an envelope detection unit (204) for detecting an envelope signal of the audio signal outputted from a sound source, a vibration transmission member for allowing the listener to perceive vibration of a low-frequency sound outputted from a low-frequency output speaker that outputs audio signals, and a frequency conversion unit (205) for generating an audio signal frequency-converted on the basis
(Continued)

of resonant frequencies by multiplying the envelope signal by sine waves having the same frequencies as resonance frequencies obtained from an impulse response of the low-frequency output speaker disposed in the vibration transmission member. The audio signal frequency-converted by the frequency conversion unit (205) is outputted from the low-frequency output speaker.

4 Claims, 14 Drawing Sheets

(56) References Cited

U.S. PATENT DOCUMENTS

| | | | | |
|---|---|---|---|---|
| 4,750,208 | A | 6/1988 | Yamada et al. | |
| 9,173,020 | B2 * | 10/2015 | Cheng | H04R 3/00 |
| 2005/0018862 | A1 * | 1/2005 | Fisher | H03G 7/007 381/98 |
| 2009/0316912 | A1 * | 12/2009 | De Poortere | H04R 3/04 381/1 |

FOREIGN PATENT DOCUMENTS

| | | |
|---|---|---|
| JP | 01-208099 | 8/1989 |
| JP | 03-085096 | 4/1991 |
| JP | 2004-023489 | 1/2004 |
| JP | 2007-065038 | 3/2007 |
| JP | 2008-072165 | 3/2008 |
| WO | WO 2012/024144 | 2/2012 |

OTHER PUBLICATIONS

Supplementary European Search Report for corresponding EP Application No. 15774304.8, Aug. 24, 2017.

* cited by examiner

VIBRATION AUDIO SYSTEM, VIBRATION AUDIO OUTPUT METHOD, AND VIBRATION AUDIO PROGRAM

TECHNICAL FIELD

The present invention relates to a vibration audio system, a vibration audio output method, and a vibration audio program. More specifically, the invention relates to a vibration audio system, a vibration audio output method, and a vibration audio program that allow the listener to perceive, as vibration, a sound outputted from an sound source.

BACKGROUND ART

There have been proposed many seat audio systems whose speaker is disposed in a car seat in order to increase sound effects in the car interior (for example, see Patent Literatures 1 and 2). A typical seat audio system includes a full-range speaker which is disposed near the headrest of a seat and can reproduce a low-to-high wide-range sound and a subwoofer which is disposed in a mid portion or a lower portion of the seat and can predominantly reproduce a low-frequency sound.

By disposing a subwoofer so as to be embedded in a seat, the seat vibrates in accordance with the level of a low-frequency signal of music, and the vibration is transmitted to the listener. A combination of a sound and vibration can provide higher realism to the listener. Typical examples of a subwoofer embedded in a seat include dynamic speakers, which use a cone paper or the like, and exciters, which output a sound by vibrating the contact surface.

Further, by outputting various types of warning sounds from a sound source, such a subwoofer can not only give an acoustic warning to the listener using a sound (warning sound) but also give a tactile warning to the listener using vibration. Thus, it is possible to increase the degree to which the listener recognizes the warning.

CITATION LIST

Patent Literature

PTL 1: Japanese Unexamined Patent Application Publication No. 2007-65038

PTL 2: Japanese Unexamined Patent Application Publication No. 2008-72165

SUMMARY OF INVENTION

Technical Problem

However, in the case of a seat audio system whose subwoofer is embedded in a seat so that the listener perceives audio output and vibration, a sound outputted from the subwoofer tends to significantly attenuate in the middle of traveling from the inside to the surface of the seat, and the vibration components tend to significantly attenuate as well. For this reason, the subwoofer needs to output a high-level audio signal so that the listener seated on the seat sufficiently perceives vibration. However, outputting a high-level audio signal requires a power amplifier having a high amplification factor and a large output, disadvantageously resulting in an increase in power consumption and an increase in cost.

In particular, giving a warning using vibration requires creating large vibration so that the person seated on the seat reliably becomes aware of the warning. Consequently, power consumption and cost are further increased.

Similarly, when a subwoofer is disposed in a member other than a seat capable of transmitting vibration, the output (vibration) of a sound disadvantageously significantly attenuates before the listener perceives the vibration.

The present invention has been made in view of the foregoing, and an object thereof is to provide a vibration audio system, vibration audio output method, and vibration audio program that when transmitting an audio signal outputted from a sound source to the listener in the form of vibration, can output vibration that the listener can perceive while reducing the output level of the signal and reducing power consumption.

Solution to Problem

In order to solve the above problems, a vibration audio system of one aspect of the present invention includes an envelope detection unit configured to detect an envelope signal by obtaining an absolute value of amplitude of an audio signal outputted from a sound source and then integrating the absolute value, a vibration transmission member having therein a low-frequency output speaker for outputting the audio signal and configured to allow a listener to perceive vibration of a low-frequency sound outputted from the low-frequency output speaker, and a frequency conversion unit configured to generate an audio signal frequency-converted on the basis of resonant frequencies by multiplying the envelope signal by sine waves, the resonant frequencies being obtained from an impulse response of the low-frequency output speaker disposed in the vibration transmission member, the sine waves having the same frequencies as the resonant frequencies. The audio signal frequency-converted by the frequency conversion unit is outputted from the low-frequency output speaker.

A vibration audio output method of another aspect of the present invention includes an envelope detection step of, by an envelope detection unit, detecting an envelope signal by obtaining an absolute value of amplitude of an audio signal outputted from a sound source and then integrating the absolute value, a frequency conversion step of, by a frequency conversion unit, generating an audio signal frequency-converted on the basis of resonant frequencies by multiplying the envelope signal by sine waves, the resonant frequencies being obtained from an impulse response of a low-frequency output speaker disposed in a vibration transmission member configured to allow a listener to perceive vibration of a low-frequency sound, the sine waves having the same frequencies as the resonant frequencies, and an audio signal output step of, by the low-frequency output speaker, outputting the audio signal frequency-converted in the frequency conversion step.

Yet another aspect of the present invention provides a vibration audio program for a vibration audio system for allowing a listener to perceive vibration of a low-frequency sound through a vibration transmission member by outputting a low-frequency sound from a low-frequency output speaker disposed in the vibration transmission member. The program causes the vibration audio system to perform an envelope detection function of causing an envelope detection unit to detect an envelope signal by obtaining an absolute value of amplitude of an audio signal outputted from a sound source and then to integrate the absolute value, a frequency conversion function of causing a frequency conversion unit to generate an audio signal frequency-converted on the basis of resonant frequencies by multiplying the envelope signal by sine waves, the resonant frequencies being obtained from an impulse response of the low-frequency output speaker, the sine waves having the same frequencies as the resonant frequencies, and an audio signal output function of causing the low-frequency output speaker to output the audio signal frequency-converted by the frequency conversion function.

The vibration audio system, the vibration audio output method, and the vibration audio program for the vibration audio system frequency-convert a low-frequency sound outputted from the low-frequency output speaker disposed in the vibration transmission member on the basis of the resonant frequencies of the low-frequency output speaker and thus can effectively increase the signal level of the low-frequency sound. As a result, the vibration transmitted to the listener through the vibration transmission member can be increased by performing frequency conversion using the resonant frequencies. Thus, when causing the listener to perceive the same vibration as conventional vibration, it is possible to reduce the signal level of a low-frequency sound outputted from the low-frequency output speaker compared to the conventional signal level, as well as to significantly reduce the amount of power of the amplifier or the like.

Further, the listener is allowed to perceive, as vibration, a low-frequency sound outputted from the low-frequency output speaker, and this vibration can be increased by performing frequency conversion on the basis of the resonant frequencies. Thus, for example, when giving a warning or the like to the listener, the warning or the like can be given to the listener using a sound, as well as vibration.

The vibration audio system may further include a distortion factor measurement unit configured to obtain a distortion component by removing signal components of the resonant frequencies from signal components of all frequencies of a low-frequency sound, the low-frequency sound being obtained by causing the low-frequency output speaker to output the sine waves having the same frequencies as the resonant frequencies while changing signal levels of the sine waves and then by collecting the sine waves, and to measure a distortion factor of the low-frequency output speaker by calculating a ratio of the signal components of the resonant frequencies to the distortion component in accordance with the changed signal level and a dynamic range compression unit configured to reduce a signal level of the envelope signal for each of the resonant frequencies on the basis of the distortion factor measured by the distortion factor measurement unit so that a signal level of a low-frequency sound outputted from the low-frequency output speaker becomes equal to or lower than an upper limit of a signal level that can be reproduced by the low-frequency output speaker. The frequency conversion unit frequency-converts the envelope signal whose signal level has been reduced by the dynamic range compression unit.

The vibration audio output method may further include a distortion factor measurement step of, by a distortion factor measurement unit, obtaining a distortion component by removing signal components of the resonant frequencies from signal components of all frequencies of a low-frequency sound, the low-frequency sound being obtained by causing the low-frequency output speaker to output the sine waves having the same frequencies as the resonant frequencies while changing signal levels of the sine waves and then by collecting the sine waves, and measuring a distortion factor of the low-frequency output speaker by calculating a ratio of the signal components of the resonant frequencies to the distortion component in accordance with the changed signal level and a dynamic range compression step of, by a dynamic range compression unit, reducing a signal level of the envelope signal for each of the resonant frequencies on the basis of the distortion factor measured in the distortion factor measurement step so that a signal level of a low-frequency sound outputted from the low-frequency output speaker becomes equal to or lower than an upper limit of a signal level that can be reproduced by the low-frequency output speaker. In the frequency conversion step, the frequency conversion unit frequency-converts the envelope signal whose signal level has been reduced in the dynamic range compression step.

The vibration audio program for the vibration audio system may cause the vibration audio system to further perform a distortion factor measurement function of causing a distortion factor measurement unit to obtain a distortion component by removing signal components of the resonant frequencies from signal components of all frequencies of a low-frequency sound, the low-frequency sound being obtained by causing the low-frequency output speaker to output the sine waves having the same frequencies as the resonant frequencies while changing signal levels of the sine waves and then by collecting the sine waves, and to measure a distortion factor of the low-frequency output speaker by calculating a ratio of the signal components of the resonant frequencies to the distortion component in accordance with the changed signal level and a dynamic range compression function of causing a dynamic range compression unit to reduce a signal level of the envelope signal for each of the resonant frequencies on the basis of the distortion factor measured by the distortion factor measurement function so that a signal level of a low-frequency sound outputted from the low-frequency output speaker becomes equal to or lower than an upper limit of a signal level that can be reproduced by the low-frequency output speaker. The frequency conversion function causes the frequency conversion unit to frequency-convert the envelope signal whose signal level has been reduced by the dynamic range compression function.

The above vibration audio system, the vibration audio output method, and the vibration audio program for the vibration audio system measure the distortion factor of the low-frequency output speaker on the basis of the signal components of the resonant frequencies. The vibration audio system and the like then reduce the level of the envelope signal for each resonant frequency on the basis of the distortion factor so that the signal level of a low-frequency sound outputted from the low-frequency output speaker becomes equal to or lower than the upper limit of the signal level that can be reproduced by the low-frequency output speaker, and then frequency-convert the audio signal. Thus, it is possible to prevent the output of a low-frequency sound having a signal level exceeding the reproduction capability of the low-frequency output speaker. As a result, it is possible to effectively prevent the distortion of a low-frequency sound outputted from the low-frequency output speaker and/or the burnout of the low-frequency output speaker.

In the vibration audio system, the vibration audio output method, and the vibration audio program for the vibration audio system, the vibration transmission member may be a chair on which the listener is seated.

By using, as the vibration transmission member, the chair on which the listener is seated, the listener is always in contact with the vibration transmission member for transmitting a low-frequency sound in the form of vibration. Thus, vibration can be reliably transmitted to the listener. Further, the listener seated on the chair can perceive vibration through a wider surface of the sitting part, backrest, or the like and thus can more reliably perceive the vibration.

Advantageous Effects of Invention

The vibration audio system, the vibration audio output method, and the vibration audio program for, the vibration audio system of the present invention frequency-convert a low-frequency sound outputted from the low-frequency output speaker disposed in the vibration transmission member on the basis of the resonant frequencies of the low-frequency output speaker and can effectively increase the signal level of the low-frequency sound. As a result, the vibration transmitted to the listener through the vibration transmission member can be increased by perform ling frequency conversion using the resonant frequencies. Thus, when causing the listener to perceive the same vibration as conventional vibration, it is possible to reduce the signal level of a low-frequency sound outputted from the low-frequency output speaker compared to the conventional signal level, as well as to significantly reduce the amount of power of the amplifier or the like.

Further, the listener is allowed to perceive, as vibration, a low-frequency sound outputted from the low-frequency output speaker, and this vibration can be increased by performing frequency conversion on the basis of the resonant frequencies. Thus, for example, when giving a warning or the like to the listener, the warning or the like can be given to the listener using a sound, as well as vibration.

BRIEF DESCRIPTION OF DRAWINGS

FIG. 4(*b*) is a diagram showing an example of frequency characteristics of a low-pass filter of an envelope detection unit when reproducing, as music, an audio signal from a sound source unit of the present embodiment;

FIG. 5(*b*) is a diagram showing the waveform of an absolute value detection signal obtained when the envelope detection unit detects an absolute value and the waveform of a low-pass filter output signal obtained by performing filtering using a low-pass filter;

FIG. 8(*b*) is a diagram showing frequency characteristics of the audio signal in FIG. 8(*a*); FIG. 8(*c*) is a diagram showing changes in the level of a signal sound collected using a microphone near the surface of a seat; and FIG. 8(*d*) is a diagram showing frequency characteristics of the collected signal sound;

FIG. 9(*b*) is a diagram showing frequency characteristics of the audio signal in FIG. 9(*a*); FIG. 9(*c*) is a diagram showing changes in the level of a signal sound collected using the microphone near the surface of the seat; and FIG. 9(*d*) is a diagram showing frequency characteristics of the collected signal sound;

FIG. 12(*a*) shows a case in which the level of the inputted audio signal is low; and FIG. 12(*b*) shows a case in which the level of the inputted audio signal is high;

DESCRIPTION OF EMBODIMENTS

Figure 1:
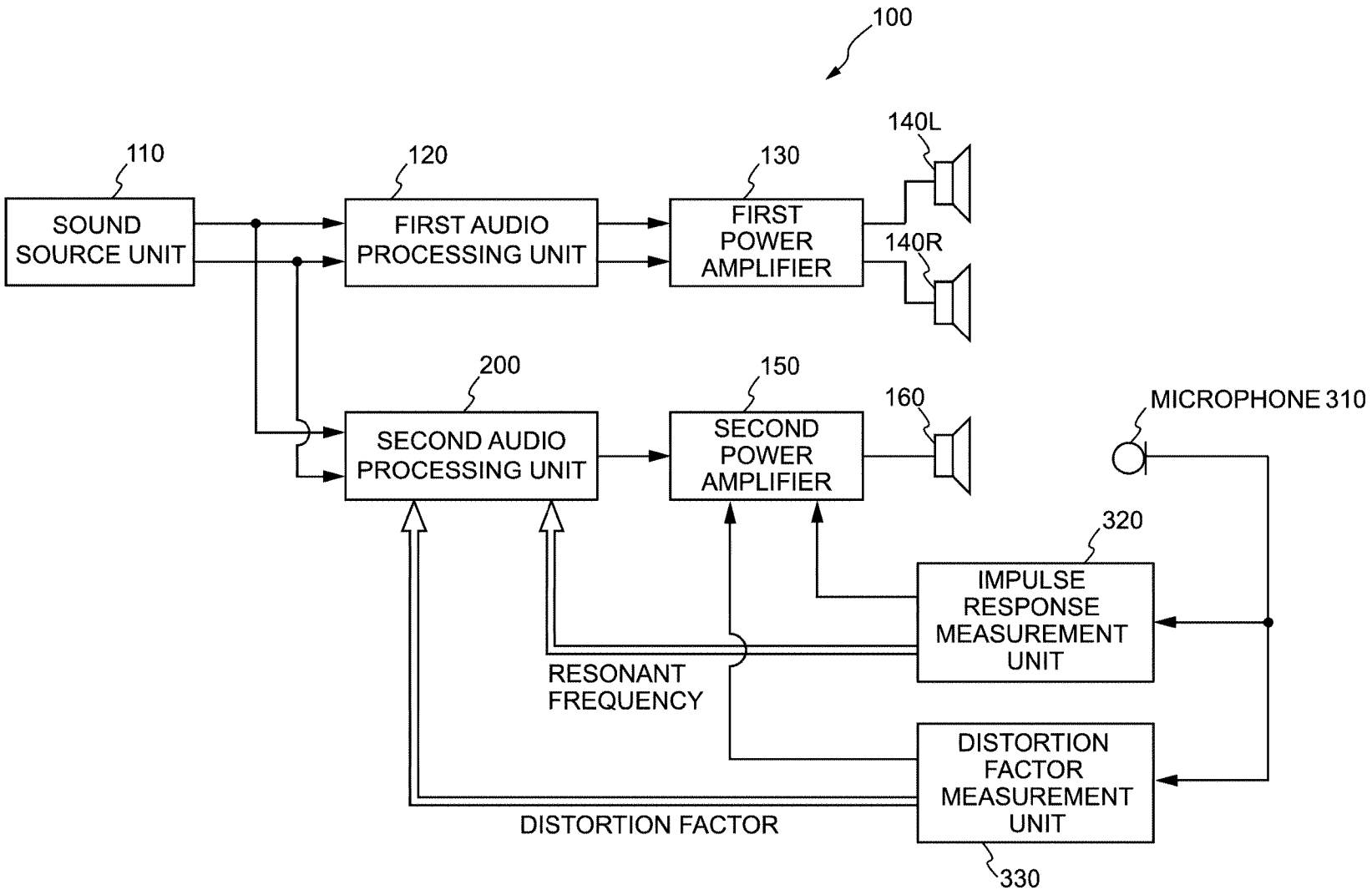
FIG. 1 is a block diagram showing a schematic configuration of a seat audio system of the present embodiment.

Now, a vibration audio system of the present invention will be described in detail using a seat audio system as an example. FIG. 1 is a block diagram showing a schematic configuration of the seat audio system.

A seat audio system 100 includes a sound source unit (sound source) 110, a first audio processing unit 120, a first power amplifier 130, a first speaker 140L, a second speaker 140R, a second audio processing unit 200, a second power amplifier 150, and a subwoofer (low-frequency output speaker) 160. The seat audio system 100 also includes a microphone 310, an impulse response measurement unit 320, and a distortion factor measurement unit 330.

The sound source unit 110 outputs L-channel and R-channel audio signals to the first audio processing unit 120 and second audio processing unit 200. The sound source unit 110 need not output normal music audio signals and may output, for example, mobile phone ringtones or various types of warning sounds. If the seat audio system 100 is used as a car-mounted audio system, for example, the sound source unit 110 can output, as audio signals, a warning sound in conjunction with a warning display on a meter panel, or can output a detection warning sound as audio signals when an obstacle is detected by an outside-car obstacle detector. The sound source unit 110 is not limited to devices having a function of reproducing audio signals, such as a CD or DVD, and may be a sound source unit having a function of acquiring audio signals outputted (reproduced) by another device through, for example, an external input terminal and outputting them to at least the second audio processing unit 200 or the like.

The first audio processing unit 120 performs processing, such as volume control, on the audio signals acquired from the sound source unit 110. For example, the first audio processing unit 120 is a volume control device for controlling the volume of the received audio signals, or an equalizer for performing sound field correction or the like in accordance with the preference of the listener. After performing audio processing such as volume control, the first audio processing unit 120 outputs the resulting audio signals to the first power amplifier 130.

The first power amplifier 130 amplifies the audio signals received from the first audio processing unit 120 and outputs the resulting audio signals to the first speaker 140L and second speaker 140R. The first speaker 140L and second speaker 140R are full-range speakers capable of outputting low-to-high wide-range signals.

Figure 2A:
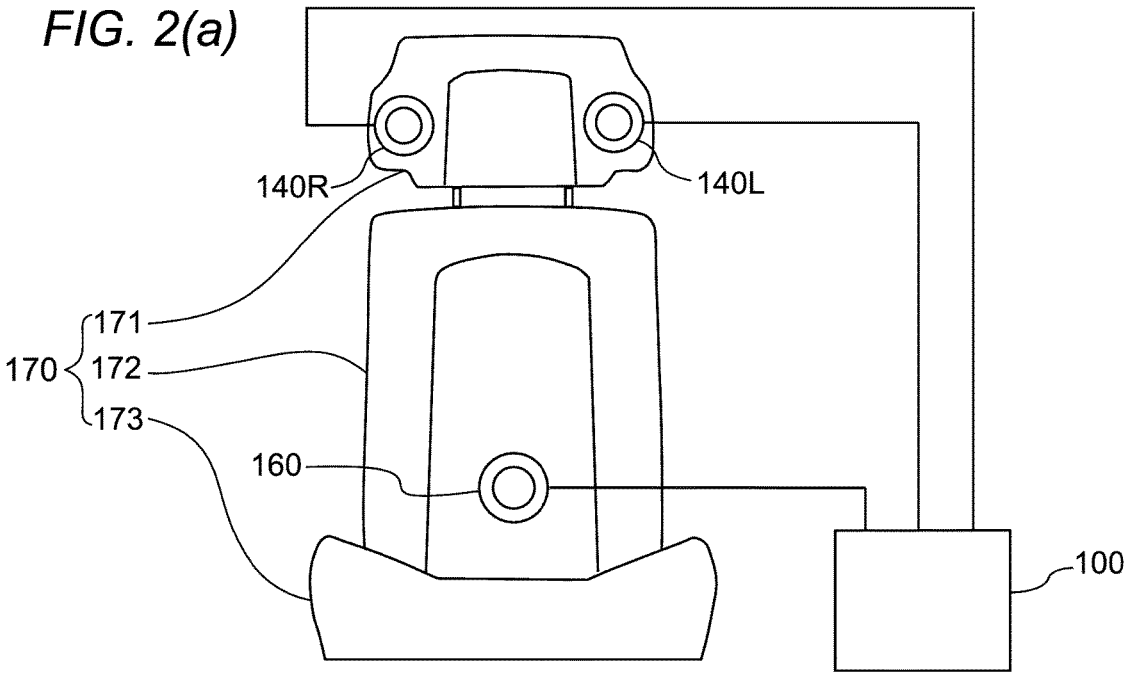
FIGS. 2(*a*) and 2(*b*) are diagrams showing a state in which a first speaker, a second speaker, and a subwoofer of the present embodiment are disposed in a seat.
Figure 2B:
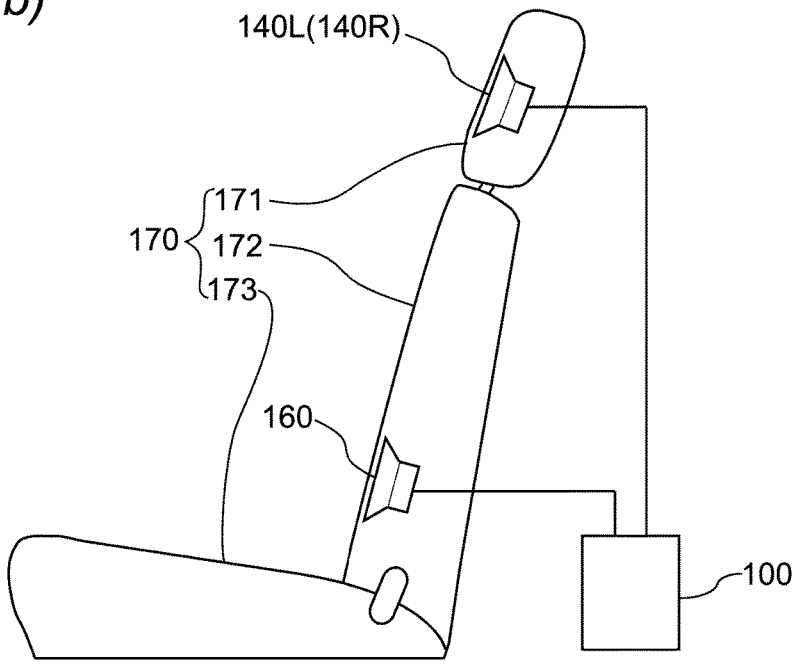

FIGS. 2(*a*) and 2(*b*) show an example of a state in which the first speaker 140L, second speaker 140R, and subwoofer 160 are disposed in a seat (vibration transmission member, chair) 170. The seat 170 aims to acoustically provide music or the like to a seated listener, as well as to allow the listener to perceive vibration on the basis of low-frequency components of music or the like. The seat 170 includes a headrest 171, a backrest (vibration transmission member) 172, and a sitting part 173.

As shown in FIGS. 2(*a*) and 2(*b*), the first speaker 140L and second speaker 140R are disposed in the headrest 171 of the seat 170 so as to be near the left and right ears of the listener. By disposing the first speaker 140L and second speaker 140R in these positions, the listener is allowed to listen to the L-channel and R-channel audio signals from the horizontal direction.

The sitting part 173 is structured to support the seated listener from below and has the backrest 172 tiltably mounted thereon.

The backrest 172 has therein the subwoofer 160 in such a manner that the listener seated on the seat 170 can perceive the vibration of an audio output. For example, as shown in FIGS. 2(*a*) and 2(*b*), disposing the subwoofer 160 around the waist of the listener allows vibration to be transmitted from the waist to the back. In the present embodiment, an exciter is used as an example of the subwoofer 160.

The listener can adjust the tilt angle of the backrest 172 in accordance with his or her preference. The backrest 172 is structured to support the back of the listener, whereas the headrest 171 mounted on an upper portion of the backrest 172 is structured to support the head of the listener. Thus, when the first speaker 140L, second speaker 140R, and subwoofer 160 output audio signals with the listener seated on the seat 170, the listener can listen to, as sounds, the L-channel audio signal from the first speaker 140L disposed near the left ear, the R-channel audio signal from the second speaker 140R disposed near the right ear, and the low-frequency audio signal from the subwoofer 160, as well as can perceive, as vibration, the audio signal through the backrest 172.

The second audio processing unit 200 extracts only low-frequency components from the audio signals received from the sound source unit 110 and frequency-converts the extracted low-frequency audio signal. A specific configuration of the second audio processing unit 200 and a process performed thereby will be described later. The second audio processing unit 200 outputs the resulting low-frequency audio signal to the second power amplifier 150.

The second power amplifier 150 amplifies the audio signal received from the second audio processing unit 200 and then outputs the resulting audio signal to the subwoofer 160.

Figure 3:
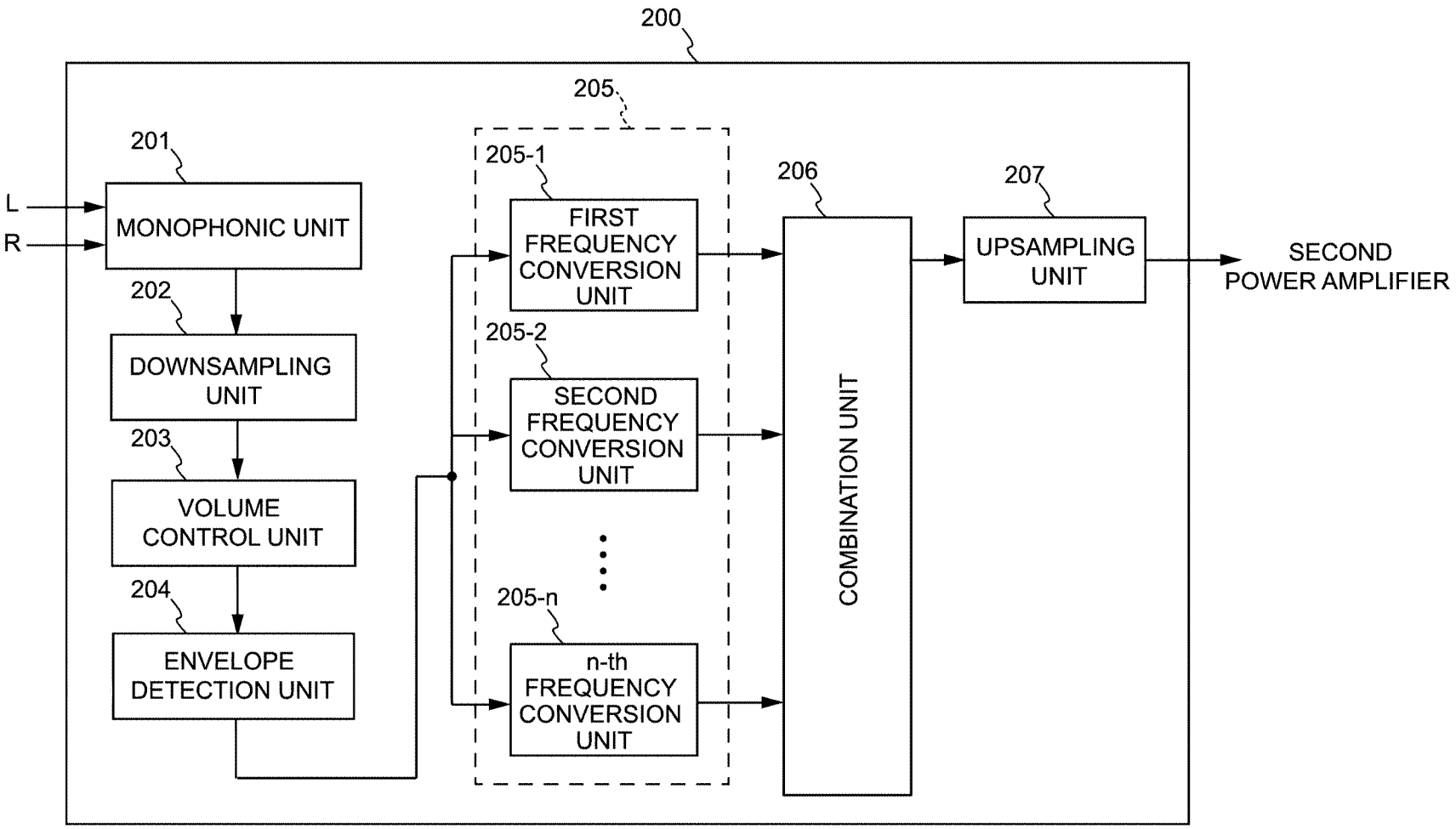
FIG. 3 is a block diagram showing a schematic configuration of a second audio processing unit of the present embodiment.

FIG. 3 is a block diagram showing a schematic configuration of the second audio processing unit 200. The second audio processing unit 200 includes a monophonic unit 201, a downsampling unit 202, a volume control unit 203, an envelope detection unit 204, n number of frequency conversion units 205 (a first frequency conversion unit 205-1, a second frequency conversion unit 205-2, . . . and an n-th frequency conversion unit **205-*n*), a combination unit 206, and an upsampling unit 207**.

The monophonic unit 201 combines the L-channel and R-channel audio signals received from the sound source unit 110 into a monophonic signal. The monophonic unit 201 outputs the monophonic audio signal to the downsampling unit 202.

Downsampling Process

To reduce the amount of signal processing operation in the volume control unit 203, envelope detection unit 204, frequency conversion units 205, and combination unit 206, the downsampling unit 202 passes the monophonic audio signal through a low-pass filter and then decimates the resulting signal by reducing the sampling frequency. As seen above, the downsampling unit 202 reduces the data amount of the audio signal to be processed by decimating the signal. The cut-off frequency of the low-pass filter of the downsampling unit 202 is set on the basis of the frequency range of the sound source, of an audio signal outputted from the subwoofer 160.

Figure 4A:
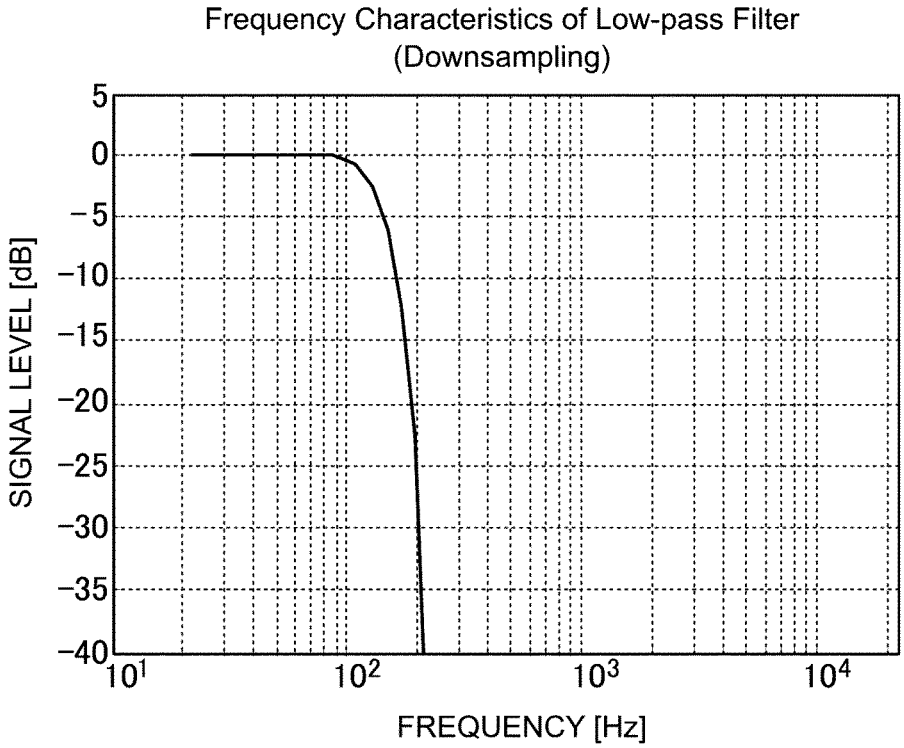
FIG. 4(*a*) is a diagram showing frequency characteristics of an example of a low-pass filter of the present embodiment.
Figure 4B:
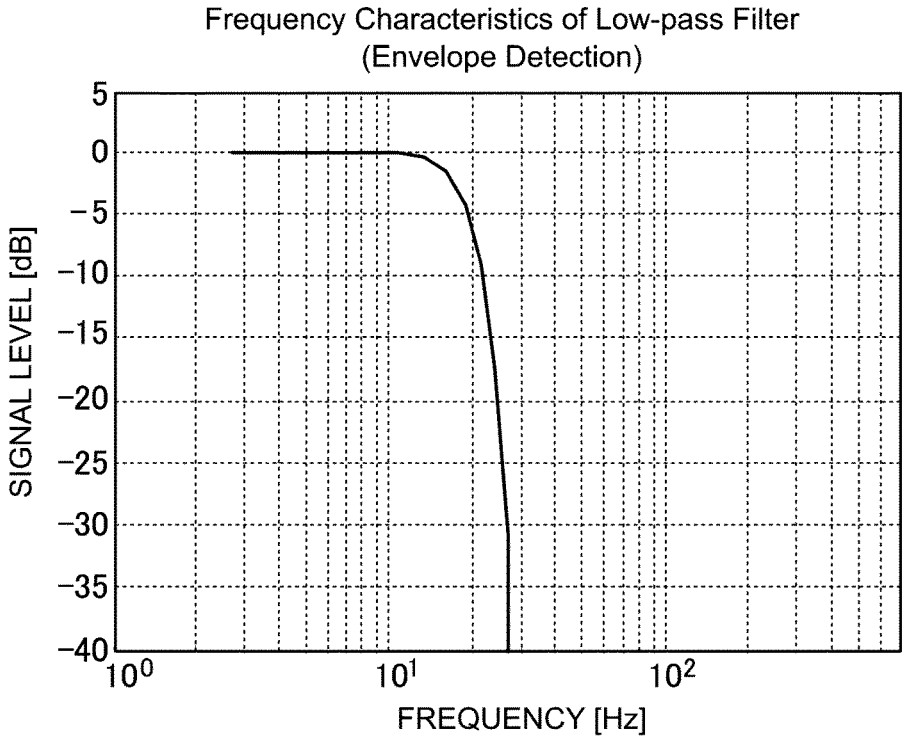

FIG. 4(*a*) is a diagram showing frequency characteristics of an example of the low-pass filter used by the downsampling unit 202 of the present embodiment. As shown in FIG. 4(*a*), the downsampling unit 202 of the present embodiment uses a 1,024-tap FIR filter as a low-pass filter and sets the cut-off frequency to 150 Hz. After filtering the audio signal using the low-pass filter shown in FIG. 4(*a*), the downsampling unit 202 sets the downsampling number to 32 and decimates the resulting audio signal with a reduced sampling frequency. Thus, the audio signal sampled with a sampling frequency of 44.1 kHz is downsampled to 1.38 kHz.

Volume Control Process

The volume control unit 203 controls the volume of the downsampled audio signal. The listener can control the level of the low-frequency signal outputted from the subwoofer 160 to a desired level by controlling the volume using the volume control unit 203.

Envelope Detection Process

The envelope detection unit 204 detects an envelope of the audio signal by detecting the absolute value of the audio signal volume-controlled by the volume control unit 203 and then integrating (filtering) the absolute value using a low-pass filter.

FIG. 4(*b*) shows an example of frequency characteristics of a low-pass filter of the envelope detection unit 204 when reproducing, as music, the audio signal from the sound source unit 110. The low-pass filter shown in FIG. 4(*b*) is a 256-tap FIR filter, and the cut-off frequency is set to 20 Hz.

Figure 5A:
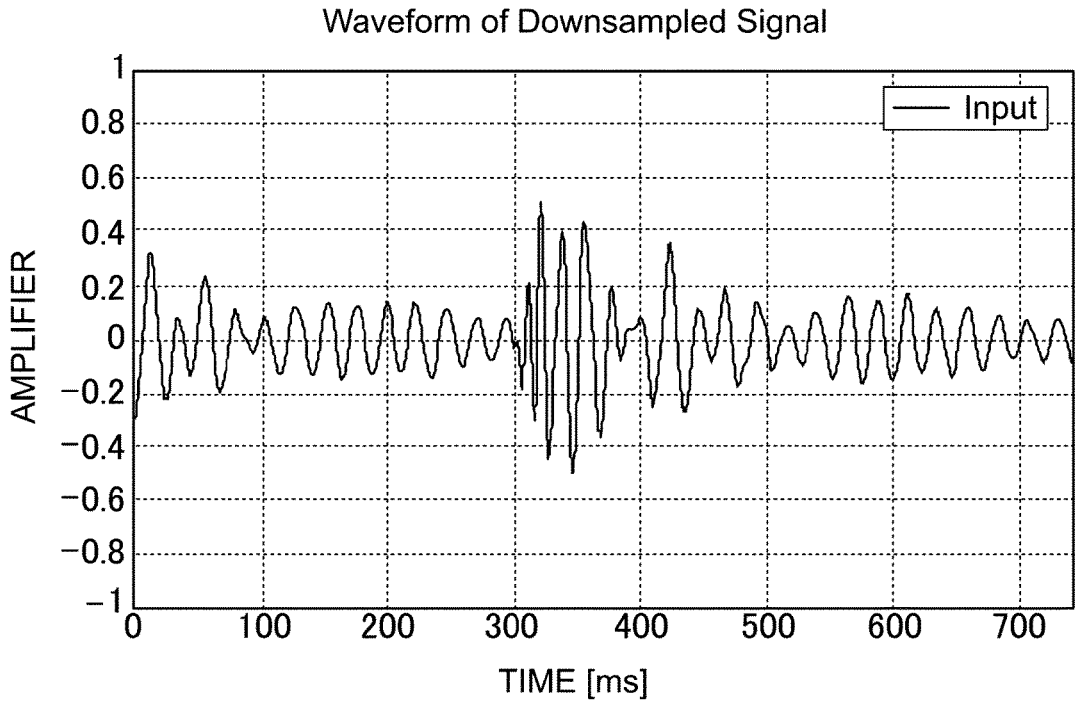
FIG. 5(*a*) is a diagram showing the waveform of a downsampled signal inputted to the envelope detection unit of the present embodiment.
Figure 5B:
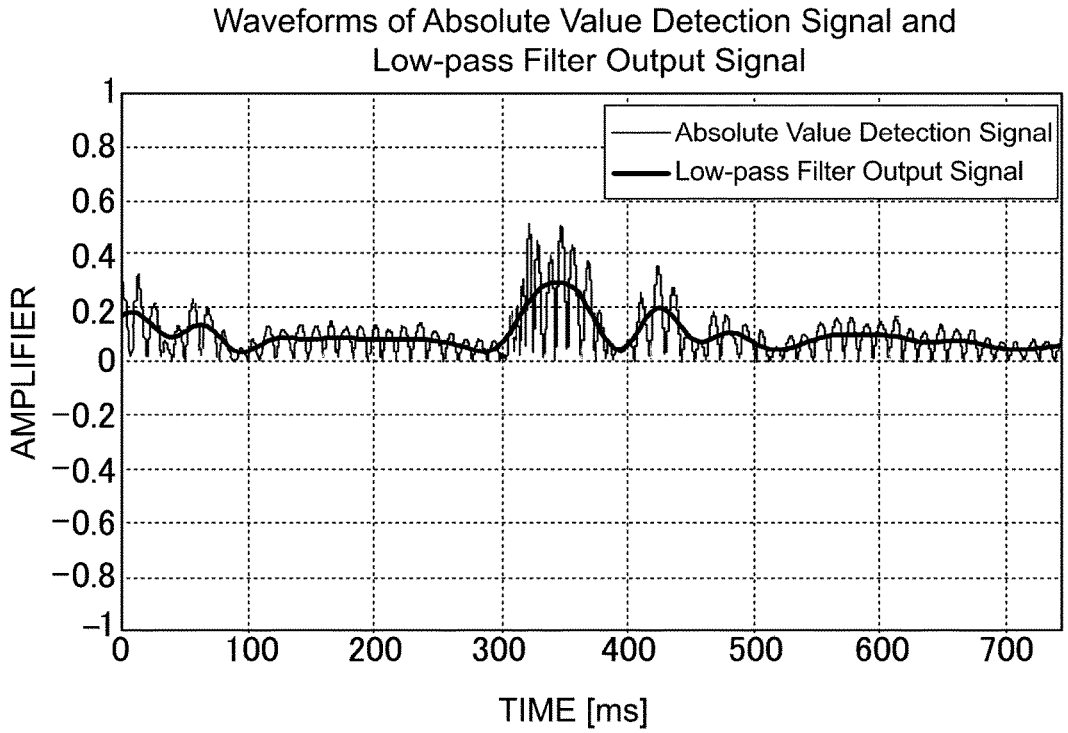
Figure 6:
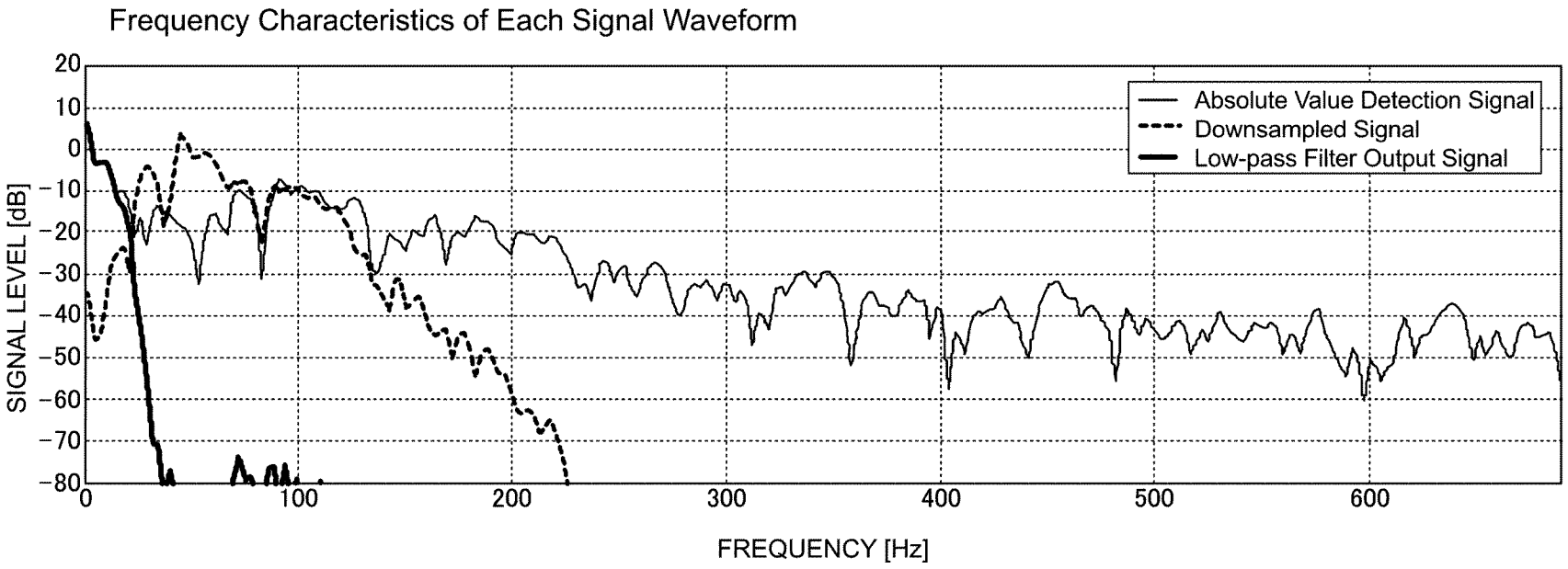
FIG. 6 is a diagram showing frequency characteristics of the downsampled signal, absolute value detection signal, and low-pass filter output signal of the present embodiment.

FIG. 5(*a*) shows the waveform of the signal inputted to the envelope detection unit 204 (the signal downsampled by the downsampling unit 202 and then volume-controlled by the volume control unit 203). FIG. 5(*b*) shows the waveforms of the signal obtained by detecting the absolute value using the envelope detection unit 204 (the absolute value detection signal) and the signal obtained by integrating (filtering) the absolute value using the low-pass filter (the low-pass filter output signal). FIG. 6 shows frequency characteristics of the downsampled signal, absolute value detection signal, and low-pass filter output signal.

As shown in FIGS. 5(*a*), 5(*b*), and 6, the envelope detection unit 204 detects an envelope signal by processing the received downsampled signal to detect an absolute value detection signal and then generating a low-pass filter output signal. The envelope signal (low-pass filter output signal) shown in FIG. 6 indicates that an audio signal of 20 Hz or less has been detected as a baseband signal.

Frequency Conversion Process

The frequency conversion units 205 frequency-convert the envelope signal serving as a baseband signal on the basis of resonant frequencies. The resonant frequencies used by the frequency conversion units 205 are determined on the basis of the frequency state (more specifically, peak frequencies) of an impulse response measured by the impulse response measurement unit 320 shown in FIG. 1.

Figure 7:
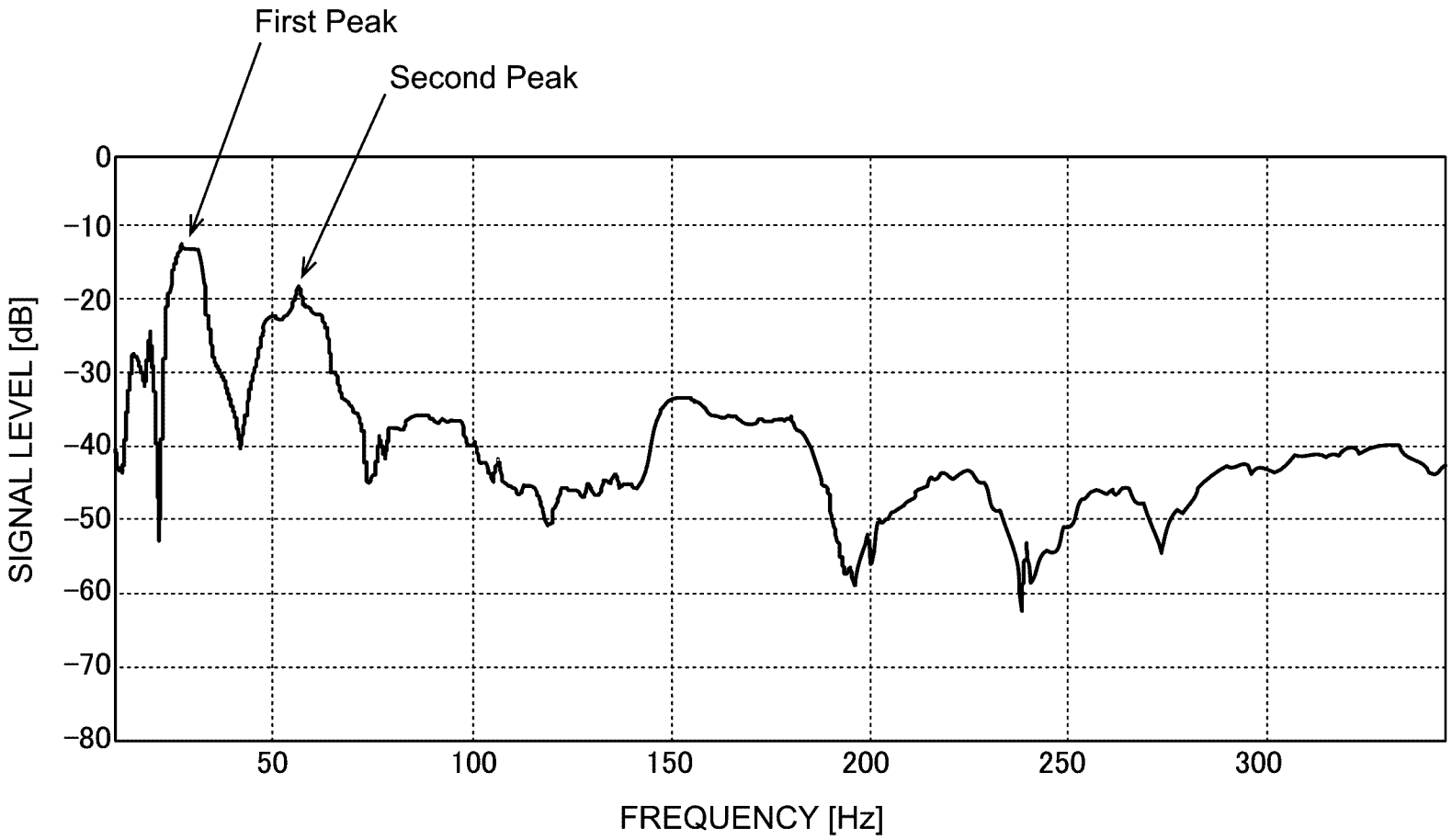
FIG. 7 is a diagram showing frequency characteristics of an impulse response obtained by the subwoofer of the present embodiment.
Figure 8B:
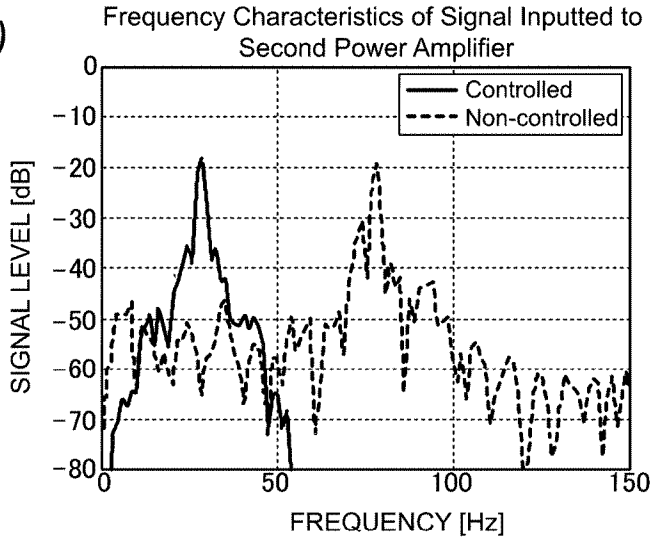
FIG. 8(*a*) is a diagram showing changes in the level of an audio signal inputted to a second power amplifier.
Figure 8A:
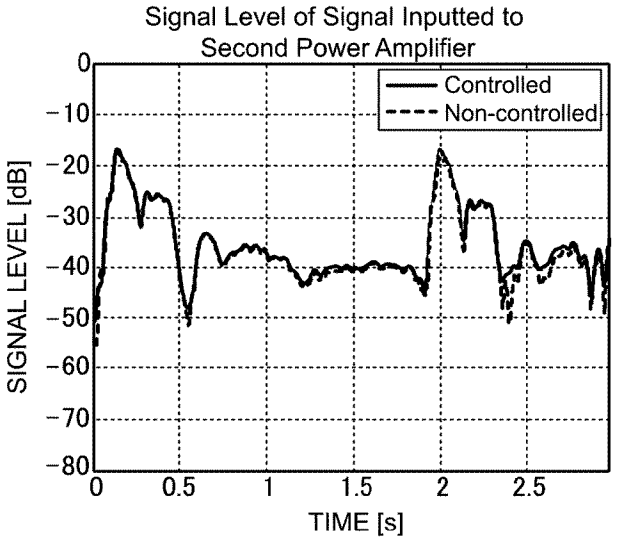
Figure 8D:
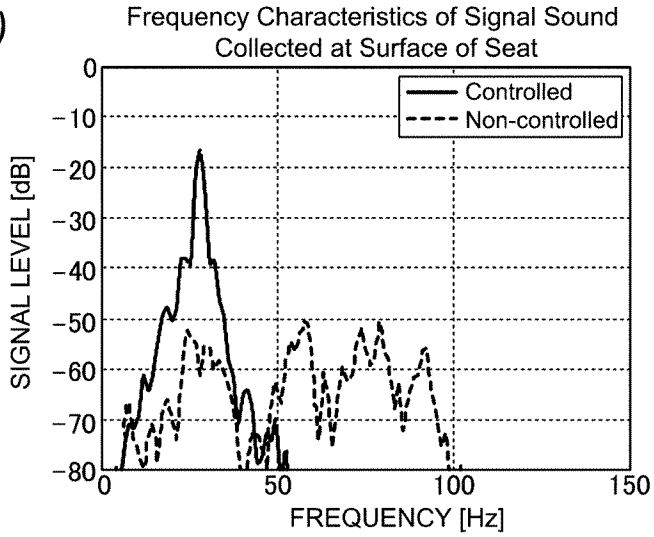
Figure 8C:
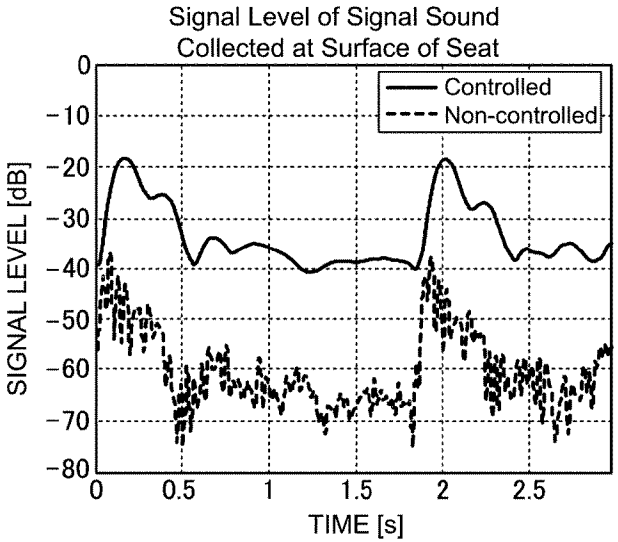
Figure 9A:
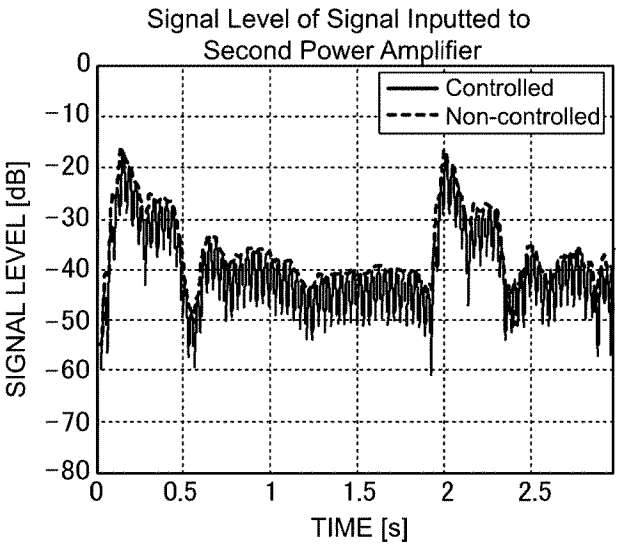
FIG. 9(*a*) is a diagram showing changes in the level of another audio signal inputted to the second power amplifier.
Figure 9B:
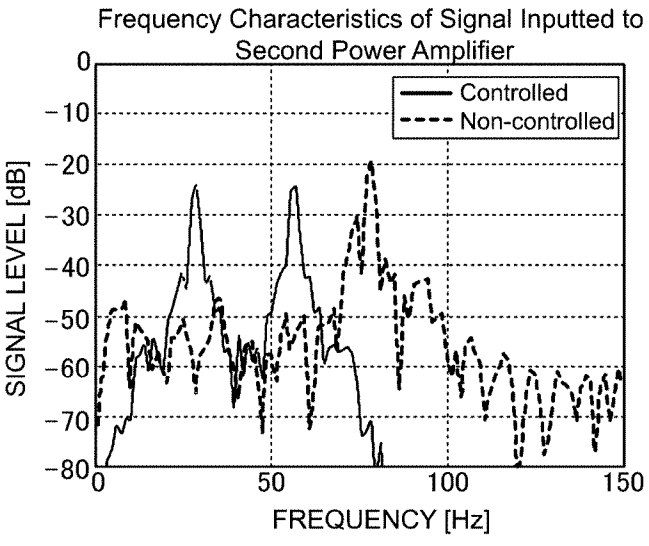
Figure 9C:
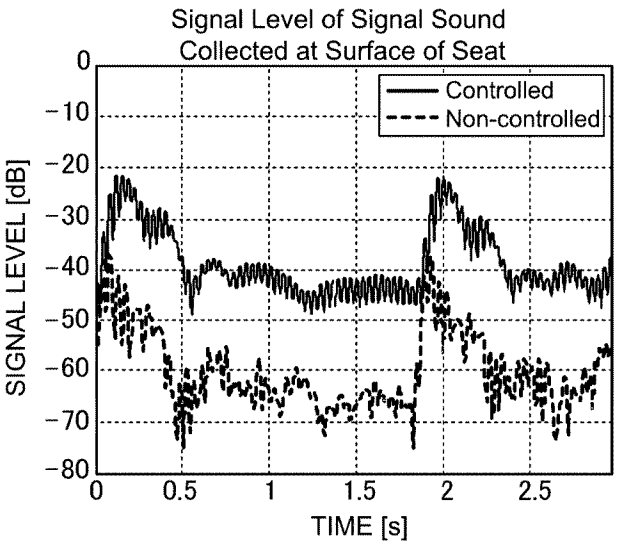
Figure 9D:
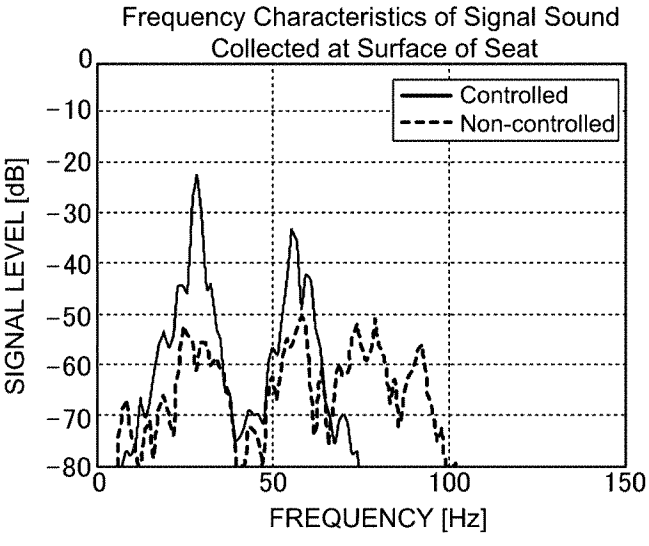

FIG. 7 shows an example of frequency characteristics of an impulse response obtained by measuring, using the microphone 310, an audio signal (impulse signal) outputted from an exciter serving as the subwoofer 160. By measuring an impulse response of the audio signal outputted from the subwoofer 160 using the microphone 310, it is possible to measure sound reproduction characteristics between the subwoofer 160 and the surface of the backrest 172. FIG. 7 shows frequency characteristics obtained by Fourier-transforming the measured impulse response.

FIG. 7 reveals that two peak frequencies having high signal levels and serving as resonant frequencies have been detected in the sound reproduction characteristics. In the present embodiment, a first peak frequency of 28 Hz is referred to as the first resonant frequency (a resonant frequency where n=1), and a second peak frequency of 56 Hz as the second resonant frequency (a resonant frequency where n=2).

The resonant frequency of the first frequency conversion unit 205-1 is set to the first resonant frequency of 28 Hz. The resonant frequency of the second frequency conversion unit 205-2 is set to the second resonant frequency of 56 Hz.

The first frequency conversion unit 205-1 multiplies the baseband signal (envelope signal) detected by the envelope detection unit 204 by a sine wave of 28 Hz, which is the same as the resonant frequency, and thus generates a low-frequency signal where the resonant frequency of 28 Hz is emphasized. The second frequency conversion unit multiplies the baseband signal (envelope signal) detected by the envelope detection unit 204 by a sine wave of 56 Hz, which is the same as the resonant frequency, and thus generates a low-frequency signal where the resonant frequency of 56 Hz is emphasized.

In the present embodiment, the two frequencies, 28 Hz and 56 Hz, are detected as resonant frequencies, as shown in FIG. 7. For this reason, the case in which the two (n=2) frequency conversion units, the first frequency conversion unit 205-1 and second frequency conversion unit 205-2, are provided as the frequency conversion units 205 has been described as an example. However, if n number of peaks serving as resonant frequencies are detected, n number of frequency conversion units 205-1 to **205-*n*** perform frequency conversion on the basis of the n number of resonant frequencies.

Combination Process

The combination unit 206 combines the baseband signals frequency-converted by the n number of frequency conversion units 205. The combination unit 206 combines the baseband signals by adding the signals frequency-converted by the respective frequency conversion units 205 (the first to n-th frequency conversion units 205-1 to **205-*n*). Due to this combination process, the signals frequency-converted so as to correspond to the respective resonant frequencies are combined into one signal. The "frequency conversion process" of the present invention refers to a process including the two processes: frequency conversion performed by the frequency conversion units 205 and the combination process performed by the combination unit 206. The combination unit 206 outputs the combined low-frequency signal to the upsampling unit 207**.

Upsampling Process

The upsampling unit 207 inserts zero corresponding to the upsampling number into the signal received from the combination unit 206 and then removes aliasing components using a low-pass filter similar to that of the downsampling unit. For example, when the upsampling number is 32, the sampling frequency of 1.38 kHz is converted to 44.1 kHz, which is similar to the sampling frequency of the audio signal outputted from the sound source unit 110.

FIG. 8(*a*) shows changes in the level of the audio signal inputted to the second power amplifier 150 (the audio signal upsampled by the upsampling unit 207). FIG. 8(*b*) shows frequency characteristics of the audio signal in FIG. 8(*a*). FIG. 8(*c*) shows changes in the level of a signal sound collected by the microphone 310 near the surface of the seat 170. FIG. 8(*d*) shows frequency characteristics of the collected signal sound. A "non-controlled" signal shown in FIGS. 8(*a*) to 8(*d*) represents the low-frequency signal outputted to the second power amplifier 150 without being frequency-converted by the frequency conversion units 205; a "controlled" signal represents the signal frequency-converted by the frequency conversion units 205 using a resonant frequency of 28 Hz.

As shown in FIGS. 8(*a*) and 8(*b*), the levels of the controlled and non-controlled audio signals inputted to the second power amplifier 150 are approximately the same. However, a comparison between the levels of the signal sounds outputted from the subwoofer 160 and then collected near the surface of the seat 170 (FIGS. 8(*c*) and 8(*d*)) reveals that the level of the non-controlled signal is lower than the controlled signal by 20 dB or more. That is, the vibration level of the signal frequency-converted using the resonant frequency is determined to be higher by 20 dB or more, on the basis of a comparison between the vibration states of the surface of the seat 170.

Accordingly, in the case of the non-controlled signal, the listener seated on the seat 170 could not perceive the same vibration as that of the controlled signal unless the non-controlled signal is outputted with a higher level than that of the controlled signal by 20 dB or more. In other words, in the case of the controlled signal, the listener could perceive sufficient vibration even when outputting the controlled signal with a lower level than that of the non-controlled signal. Thus, it is possible to reduce the output of the second power amplifier 150 and thus to achieve a significant power saving.

As with FIGS. 8(*a*) to 8(*d*), FIGS. 9(*a*) to 9(*d*) show level changes (FIG. 9(*a*)) and frequency characteristics (FIG. 9(*b*)) of the audio signal inputted to the second power amplifier 150 and level changes (FIG. 9(*c*)) and frequency characteristics (FIG. 9(*d*)) of a signal sound collected by the microphone 310. Note that a controlled signal shown in FIGS. 9(*a*) to 9(*d*) differs from that in FIGS. 8(*a*) to 8(*d*) in that the signal has been frequency-converted using a resonant frequency of 28 Hz, as well as a resonant frequency of 56 Hz. The signal levels at 28 Hz and 56 Hz in FIGS. 9(*a*) and 9(*b*) have been reduced compared to those in FIGS. 8(*a*) and 8(*b*) by 6 dB. This reduction process has been performed considering that when frequency conversion is performed using two resonant frequencies and then the combination unit 206 performs a combination process, the signal level is increased compared to that when frequency conversion is performed using only one resonant frequency and then a combination process is performed.

As shown in FIGS. 9(*c*) and 9(*d*), when the vibration state near the surface of the seat 170 is detected using the audio signal frequency-converted using the two resonant frequencies, the level of the controlled signal is detected to be higher than that of the non-controlled signal by 17 dB. As seen above, when frequency conversion is performed using multiple resonant frequencies, the listener can sufficiently perceive the vibration of the controlled signal having a lower level than that of the non-controlled signal. Thus, it is possible to reduce the output of the second power amplifier 150 and thus to achieve a significant power saving.

As described above, resonant frequencies of the subwoofer 160 are previously detected, and an audio signal outputted from the subwoofer 160 is frequency-converted using the detected resonant frequencies. Thus, the listener is allowed to perceive low-frequency vibration increased using the resonance of the audio signal at the resonant frequencies. As a result, it is possible to reduce the signal output and to achieve a significant power saving compared to when frequency conversion is not performed using resonant frequencies.

When the sound source unit 110 outputs music audio signals or the like, frequency characteristics of the audio signals tend to vary in various manners. For example, as shown in FIG. 7, when frequency characteristics are obtained from an impulse response, frequencies having high signal levels can be obtained as resonant frequencies; however, when music or the like is outputted from the subwoofer 160, the frequency characteristics significantly vary. Consequently, the signal levels of frequencies other than resonant frequencies may be outputted as peaks, or the signal level may vary due to the occurrence of a dip.

For this reason, when frequency conversion based on resonant frequencies is not performed, the level of the vibration outputted from the subwoofer 160 tends to depend on characteristics of music (music signal) outputted from the sound source unit 110 and thus to significantly vary. Thus, the amount of a low-frequency sound reproduced by the full-range speakers (the first speaker 140L and second speaker 140R) disposed in the headrest 171 and the amount of low-frequency vibration outputted from the subwoofer 160 may be mismatched. The listener may feel a difference between the sound he or she is listening to and the vibration he or she is perceiving.

To eliminate such a sound-vibration difference, the vibration is controlled by frequency-converting the low-frequency audio signal using the resonant frequencies of the subwoofer 160. Due to this frequency conversion process, the listener is allowed to perceive vibration that does not depend on variations in the frequency characteristics of the music signal outputted from the sound source and corresponds to vibration characteristics of the signal. By controlling the low-frequency signal by frequency conversion using the resonant frequencies as described above, the listener is allowed to perceive vibration (the amount of vibration) corresponding to the amount of a sound reproduced by the full-range speakers.

Signal Level Reduction Process (Dynamic Range Compression Process)

As described above, by performing frequency conversion on the basis of resonant frequencies, the subwoofer 160 is allowed to reproduce a high-level signal. However, if the subwoofer 160 outputs a signal having a level exceeding the reproduction capability thereof, the signal may be clipped and distorted. Also, if the signal level becomes equal to or higher than the upper limit of the reproduction capability of the subwoofer 160, the voice coil may burn out. Hereafter, a case will be described in which the second audio processing unit additionally performs a process of compressing the dynamic range in accordance with the signal level so as to prevent the reproduction of a signal having a level exceeding the reproduction capability of the subwoofer 160.

Figure 10:
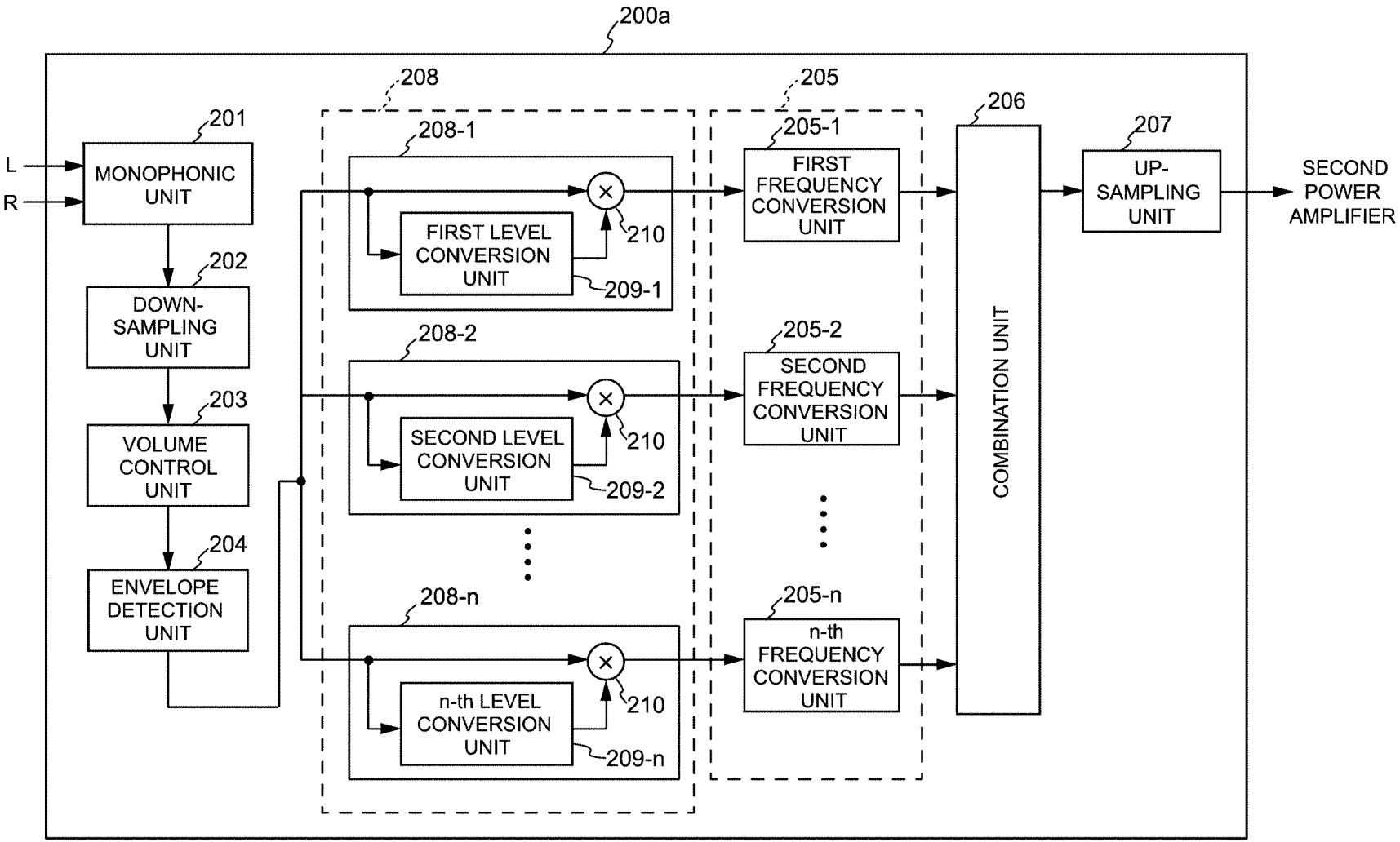
FIG. 10 is a block diagram showing a schematic configuration of another second audio processing unit in which n number of dynamic range compression units corresponding to the number n of disposed frequency conversion units are disposed between an envelope detection unit and the frequency conversion units, which differs from the configuration of the second audio processing unit shown in FIG. 3.

FIG. 10 is a block diagram showing a schematic configuration of a second audio processing unit 200*a* that differs from the configuration of the second audio processing unit 200 shown in FIG. 3. In the second audio processing unit 200*a*, n number of dynamic range compression units 208 (a first dynamic range compression unit 208-1, a second dynamic range compression unit 208-2, . . . and an n-th dynamic range compression unit 208-*n*) corresponding to the number n of disposed frequency conversion units 205 are disposed between the envelope detection unit 204 and frequency conversion units 205. The monophonic unit 201, the downsampling unit 202, the volume control unit 203, the envelope detection unit 204, the frequency conversion units 205, the combination unit 206, and the upsampling unit 207 shown in FIG. 10 are the same as those described with reference to FIG. 3 and given the same reference signs. These components will not be described.

The envelope detection unit 204 outputs an audio signal to the first to n-th dynamic range compression units 208-1 to 208-*n*. The dynamic range compression units 208 each include a level conversion unit 209 (a level conversion unit corresponding to the n-th dynamic range compression unit 208-*n* will be referred to as an n-th level conversion unit 209-*n*) and a multiplication unit 210 (the multiplication units 210 disposed in the n number of dynamic range compression units 208 have the same configuration).

The level conversion units 209-1 to 209-*n* level-convert the resonant frequencies of the corresponding frequency conversion units 205-1 to 205-*n* using a lookup table. The multiplication units 210 adjust (reduce/compress) the level of the audio signal outputted from the envelope detection unit 204 by multiplying the audio signal by the signals level-converted by the level conversion units 209. By providing the level conversion units 209 (209-1 to 209-*n*) and adjusting (reducing/compressing) the signal levels of the resonant frequencies as described above, an audio signal level exceeding the reproduction capability of the subwoofer 160 is previously reduced. Thus, the distortion of the output sound, the burnout of the subwoofer 160, or the like can be prevented.

The lookup table for the level conversion units 209 is determined on the basis of the capability for reproducing the respective resonant frequencies of the subwoofer 160. A signal level serving as the upper limit of the reproduction capability of the subwoofer 160 is determined on the basis of a distortion factor measured by the distortion factor measurement unit 330 shown in FIG. 1. The distortion factor measurement unit 330 outputs the sine waves having the same frequencies as the resonant frequencies to the second power amplifier 150 while changing the levels of the sine waves. Then, using the microphone 310, the distortion factor measurement unit 330 collects a low-frequency sound outputted from the subwoofer 160 through the second power amplifier 150 and detects a distortion factor from the collected low-frequency sound. A signal level serving as the upper limit of the reproduction capability is determined on the basis of the distortion factor.

Figure 11:
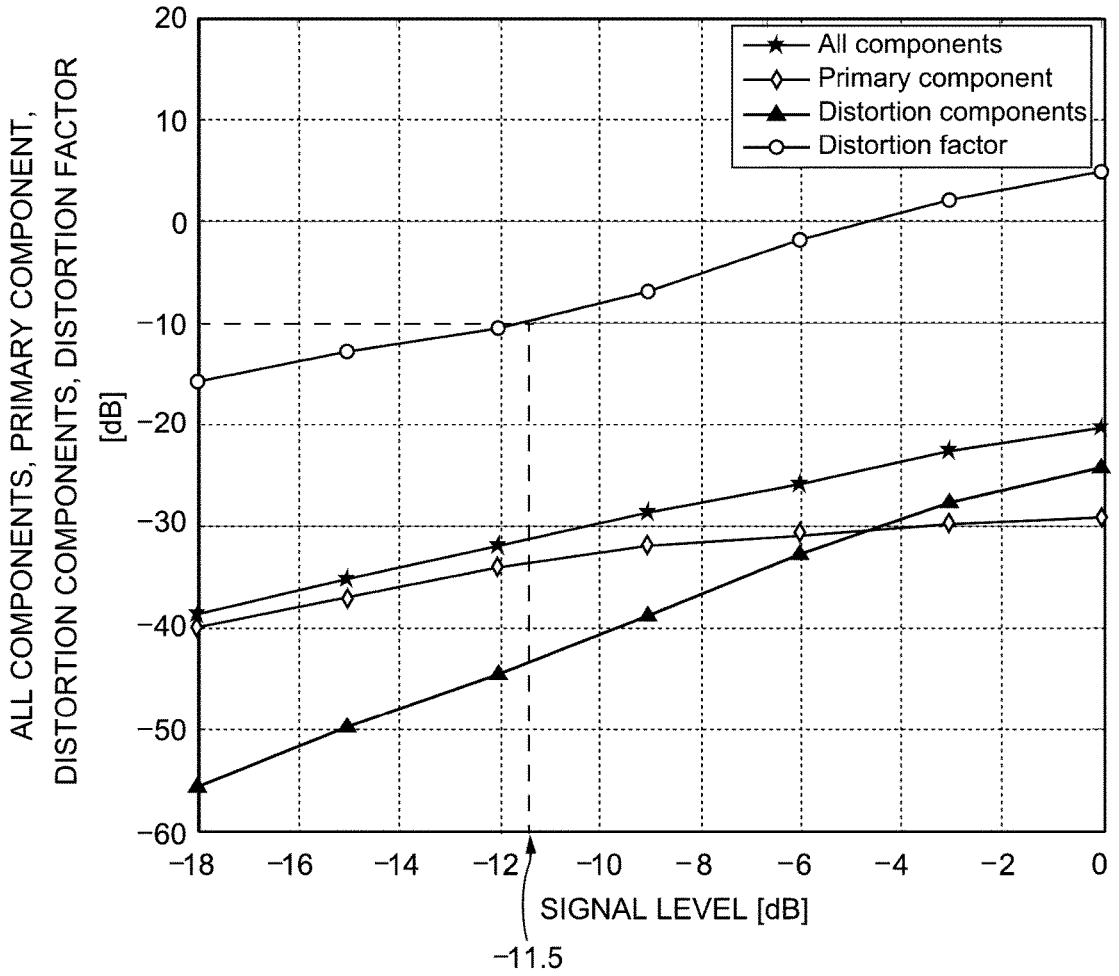
FIG. 11 is a graph showing an example of the measurement results of the signal components of all components, the signal component of a primary component, and the signal components of distortion components, and a distortion factor of the present embodiment.

FIG. 11 is a graph showing an example of measurement results such as distortion factor. FIG. 11 shows the measurement results when the signal level has been changed from −18 dB to 0 dB using a sine wave of 56 Hz, which is one of the resonant frequencies of the subwoofer 160, and outputted to the second power amplifier 150. The reason why the signal level represented by the horizontal axis of FIG. 11 is in a range of −18 dB to 0 dB is that this range corresponds to the variable range of the signal level. FIG. 11 also shows the levels of signal components of all frequencies (the values of all components in FIG. 11) and the level of a signal component of 56 Hz, which is a resonant frequency, (the value of the primary component in FIG. 11) on the basis of a low-frequency sound measured by the distortion factor measurement unit 330 through the microphone 310. FIG. 11 also shows, as distortion components, signal components resulting from the removal of the signal component of 56 Hz (the primary component) from signal components of all frequencies (all components). FIG. 11 also shows a distortion factor obtained by subtracting the distortion components from the primary component (note that a subtraction in decibel corresponds to a division in linear value).

Figure 12A:
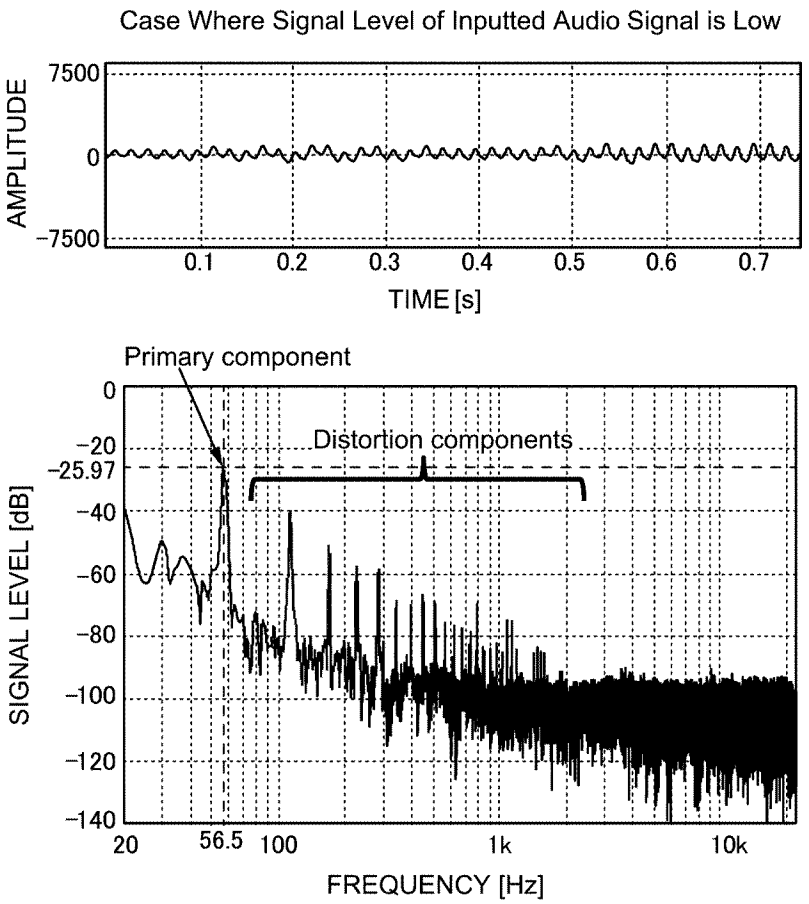
FIGS. 12(*a*) and 12(*b*) include diagrams showing the amplitude of an inputted audio signal (upper diagrams) and diagrams showing the relationship of the primary component and distortion components with the signal components of all frequencies.
Figure 12B:
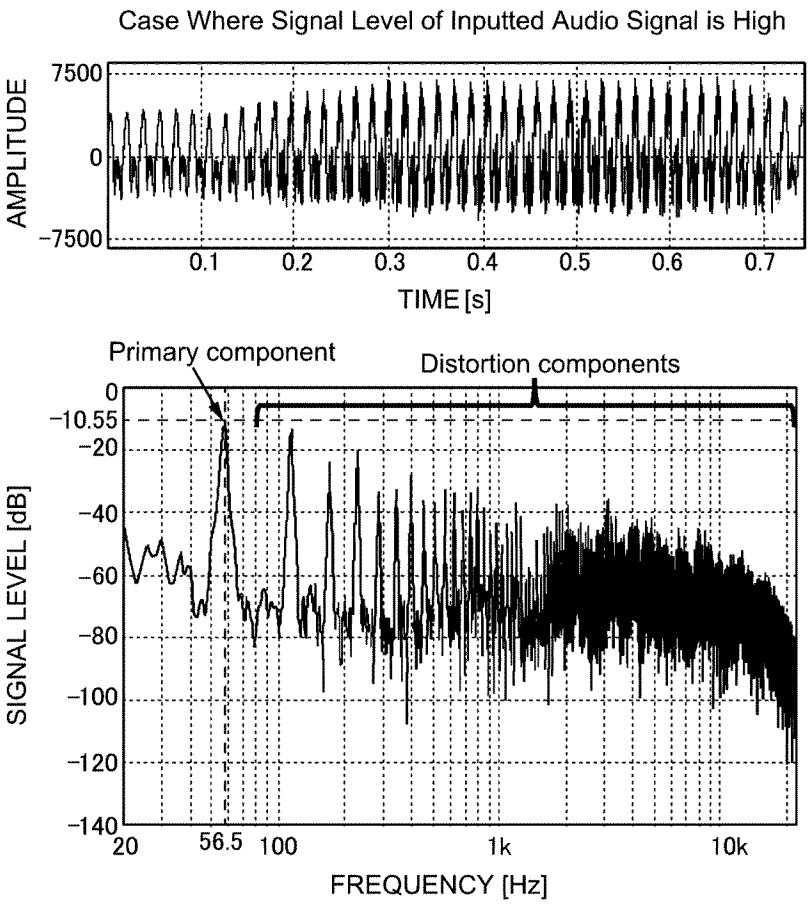

FIGS. 12(*a*) and 12(*b*) include diagrams showing the amplitude of an inputted audio signal (upper diagrams) and diagrams showing frequency characteristics of signal components of all frequencies, including the primary component and distortion components (lower diagrams). More specifically, FIG. 12(*a*) shows the amplitude of the signal level (the upper diagram of FIG. 12(*a*)) and frequency characteristics of the signal components of all frequencies (the lower diagram of FIG. 12(*a*)) when the level of the inputted audio signal is low. FIG. 12(*b*) shows the amplitude of the signal level (the upper diagram of FIG. 12(*b*)) and frequency characteristics of the signal components of all frequencies (the lower diagram of FIG. 12(*b*)) when the level of the inputted audio signal is high.

As shown in the lower diagrams of FIGS. 12(*a*) and 12(*b*), the distortion components are signal components of higher frequencies than 56 Hz, which represents the peak of the primary component, and correspond to signal components in the range in which the signal level significantly varies. That is, as shown in the lower diagrams of FIGS. 12(*a*) and 12(*b*), the components resulting from the removal of the signal component (primary component) of 56 Hz from the signal components of all frequencies (all components) are extracted as the distortion components.

For example, a signal level at which a distortion factor is −10 dB is defined as the reproduction capability of the subwoofer 160. In this case, when the distortion factor (dB) represented by the vertical axis of FIG. 11 is −10 dB, the signal level of the reproduction capability represented by the horizontal axis is −11.5 dB. The first level conversion unit 209-1, which converts the signal level at which the resonant frequency is 56 Hz, sets a lookup table in such a manner that the upper limit signal level is −11.5 dB.

Figure 13:
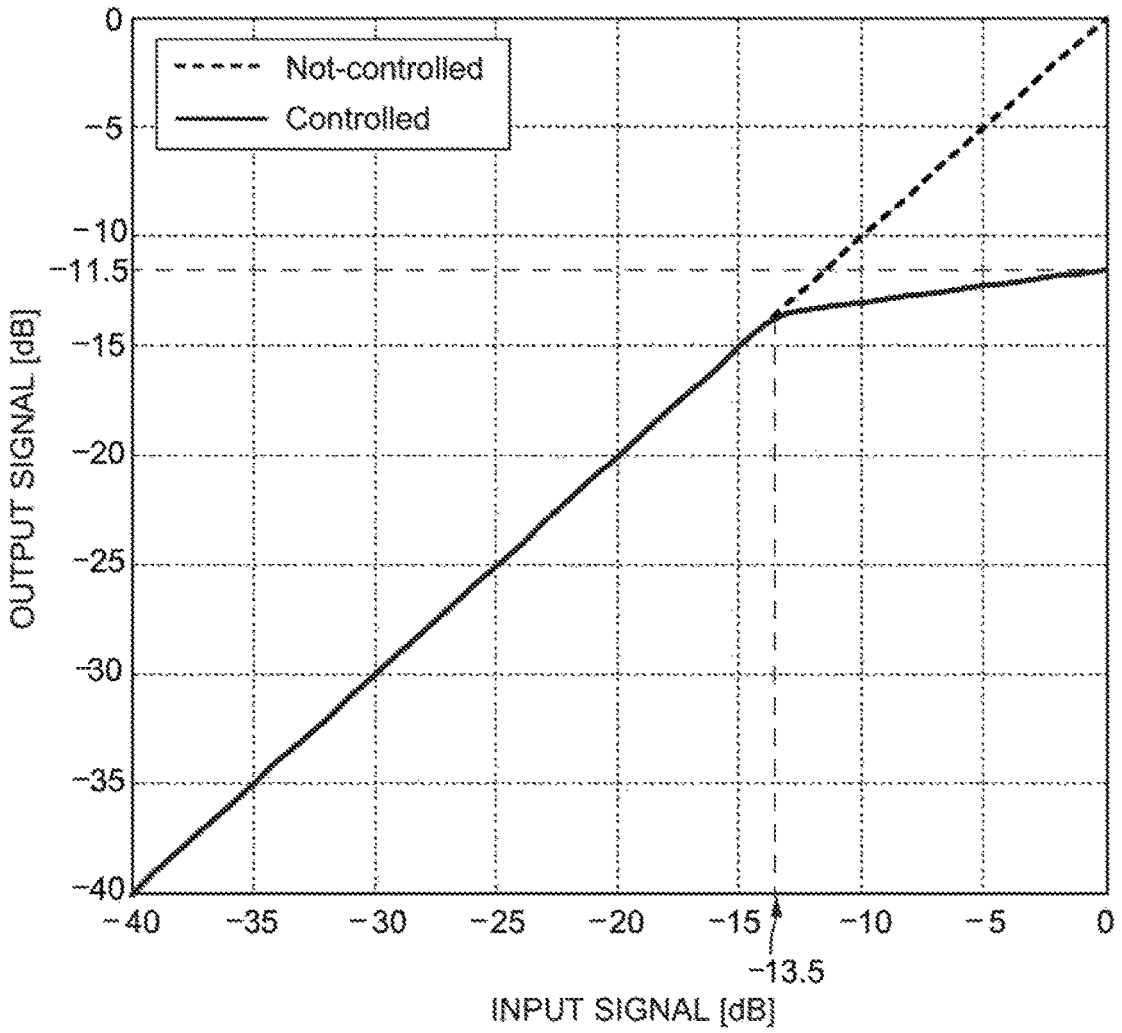
FIG. 13 is a diagram showing conversion characteristics of the signal level reduced by a first dynamic range compression unit on the basis of a lookup table set by a first level conversion unit of the present embodiment.

FIG. 13 is a diagram showing conversion characteristics of the signal level reduced by the first dynamic range compression unit 208-1 on the basis of the lookup table set by the first level conversion unit 209-1. As shown in FIG. 13, the input signal level serves as the output signal level until the input signal level becomes −13.5 dB, and therefore the signal level is not reduced.

However, when the input signal level exceeds −13.5 dB, a signal reduction process is started. When the input signal level becomes 0 dB (full scale), the input signal level is reduced so that the output signal level becomes −11.5 dB, which is a signal level obtained from the distortion factor shown in FIG. 11 and representing the reproduction capability. As seen above, a lookup table is set on the basis of the reproduction capability of the subwoofer 160 defined on the basis of the distortion factor, and the dynamic range compression units 208 perform signal level reduction processes (dynamic range compression processes). Due to these reduction processes, the signal level of a low-frequency sound to be outputted from the subwoofer 160 is prevented from exceeding the upper limit of the reproduction capability of the subwoofer 160. Thus, the distortion of a low-frequency sound outputted from the subwoofer 160 can be prevented and/or the burnout of the subwoofer 160 can be prevented.

Figure 14:
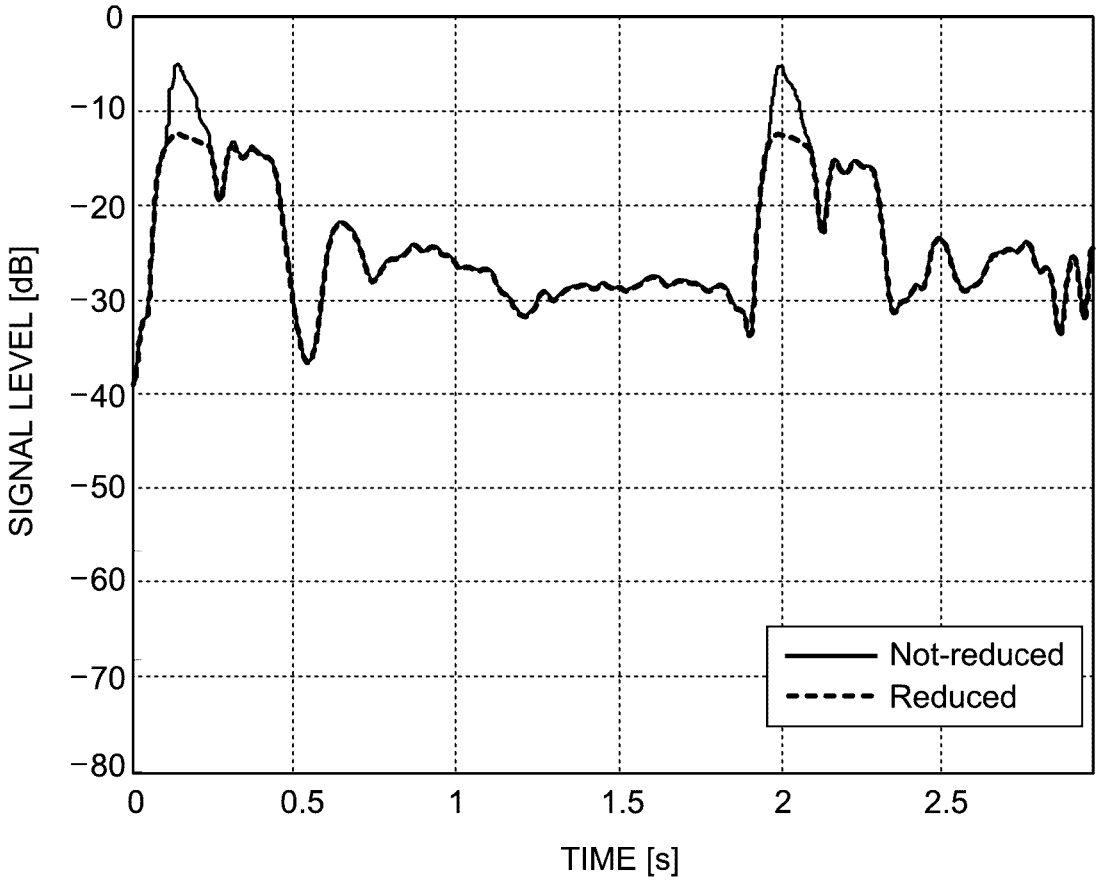
FIG. 14 is a diagram showing, on the basis of the value of the signal level of an audio signal inputted to the second power amplifier, signal level changes when dynamic range compression units perform compression processes and signal level changes when the dynamic range compression units do not perform compression processes in a case in which the level of an audio signal outputted from the sound source unit of the present embodiment is high.

FIG. 14 is a diagram showing, on the basis of the level of an audio signal inputted to the second power amplifier 150, signal level changes when the dynamic range compression units 208 perform compression processes ("reduced" in FIG. 14) and signal level changes when the dynamic range compression units 208 do not perform compression processes ("not reduced" in FIG. 14) in a case in which the levels (volumes) of audio signals outputted from the sound source unit 110 are high. Specifically, FIG. 14 shows a case in which the signal level has been increased by increasing the volume of the level of the controlled signal shown in FIG. 8(*a*) by 11 dB.

As shown in FIG. 14, in the case of "not reduced," the dynamic range compression units 208 do not reduce (limit) the signal level. Accordingly, the level of the audio signal inputted to the second power amplifier 150 is higher than −11.5 dB, which is the upper limit of the reproduction capability of the subwoofer 160. On the other hand, in the case of "reduced," the dynamic range compression units 208 reduce (limit) the signal level. Accordingly, the level of the audio signal inputted to the second power amplifier 150 is confined within −11.5 dB, which is the upper limit of the reproduction capability of the subwoofer 160. Thus, the signal level of a low-frequency sound to be outputted from the subwoofer 160 is also confined within the range (the upper limit) of the reproduction capability of the subwoofer 160. As a result, the distortion of the output sound and/or the burnout of the subwoofer 160 can be effectively prevented.

As described above, the seat audio system 100 of the present embodiment frequency-converts a low-frequency sound to be outputted from the subwoofer 160, on the basis of the resonant frequencies of the subwoofer 160 and thus can effectively increase the vibration of the low-frequency sound. Thus, a reduction in the output of the second power amplifier 150 and a significant power saving are easily achieved.

Further, the seat audio system 100 of the present embodiment obtains changes in the distortion factor on the basis of a signal component (a primary component) corresponding to each resonant frequency and determines a signal level serving as the upper limit of the reproduction capability on the basis of the distortion factor of the subwoofer 160 set as the upper limit of the reproduction capability of the subwoofer 160. By determining the signal level serving as the upper limit, the seat audio system 100 sets a lookup table for the level conversion units 209. Using the set lookup table for the level conversion units 209, the seat audio system 100 reduces the levels of audio signals outputted from the dynamic range compression units 208. Accordingly, by performing frequency conversion on the basis of the resonant frequencies, a low-frequency sound having a signal level exceeding the reproduction capability of the subwoofer 160 can be prevented from being outputted from the subwoofer 160. Thus, the distortion of a sound (low-frequency sound) outputted from the subwoofer 160 and/or the burnout of the subwoofer 160 can be effectively prevented.

Further, the seat audio system 100 of the present embodiment allows the listener to perceive an output sound as vibration. For example, by inputting a warning sound or the like in conjunction with a warning system as an audio signal of the sound source unit 110, the seat audio system 100 allows the listener to listen to a warning as a warning sound, as well as to perceive the warning as vibration. That is, it is possible to transmit an audio signal to the listener as vibration and thus to more effectively notify the listener of the warning.

Further, in the seat audio system 100 of the present embodiment, the subwoofer 160 is disposed in the backrest 172 of the seat 170. By disposing the subwoofer 160 in the seat 170, the back of the listener seated on the seat 170 is always in contact with the backrest 172 of the seat 170. Thus, vibration can be reliably transmitted to the listener. Further, the listener seated on the seat 170 can perceive vibration through a wider surface (vibration transmission surface) of the backrest 172 or the like and thus can more reliably perceive the vibration.

While the vibration audio system according to the embodiment of the present invention has been described using the seat audio system 100 as an example, the vibration audio system according to the present invention are not limited to the embodiment.

While, in the present embodiment, the subwoofer 160 of the seat audio system 100 is disposed in the backrest 172 of the seat 170, it may be disposed in other positions as long as the listener is allowed to perceive a low-frequency sound as vibration. For example, the subwoofer 160 may be disposed in the sitting part 173, headrest 171, or the like of the seat 170. Further, the subwoofer 160 only has to be disposed in an object that contacts part of the body of the listener and can transmit vibration. For example, it may be disposed in the steering wheel, armrest, or the floor mat of the vehicle.

In the example shown in FIG. 13, the level of the output signal is moderately reduced as the input signal is increased from −13.5 dB to 0 dB, so as to prevent the listener from feeling strange about signal level changes caused by the output signal reduction process. However, the reduction of the signal level need not be performed in this range. For example, the reduction of the input signal level need not be started at −13.5 dB and may be started at other signal levels. By setting a more appropriate reduction process, it is possible to alleviate the listener's strange feeling about the vibration of the output sound caused by the reduction process.

REFERENCE SINGS LIST

100 seat audio system (vibration audio system)
110 sound source unit (sound source)
120 first audio processing unit
130 first power amplifier
140L first speaker
140R second speaker
150 second power amplifier
160 subwoofer (low-frequency output speaker)
170 seat (vibration transmission member, chair)
171 headrest
172 backrest (vibration transmission member)
173 sitting part
200, 200*a* second audio processing unit
201 monophonic unit
202 downsampling unit
203 volume control unit
204 envelope detection unit
205, 205-1, . . . , 205-*n* frequency conversion unit
206 combination unit
207 upsampling unit
208, 208-1, . . . , 208-*n* dynamic range compression unit
209, 209-1, . . . , 209-*n* level conversion unit
210 multiplication unit
310 microphone
320 impulse response measurement unit
330 distortion factor measurement unit

The invention claimed is:

1. A vibration audio system comprising:

an envelope detection unit configured to detect an envelope signal by obtaining an absolute value of amplitude of an audio signal outputted from a sound source and then integrating the absolute value;

a vibration transmission member having therein a low-frequency output speaker for outputting the audio signal and configured to allow a listener to perceive vibration of a low-frequency sound outputted from the low-frequency output speaker;

a frequency conversion unit configured to generate an audio signal frequency-converted on the basis of resonant frequencies by multiplying the envelope signal by sine waves, the resonant frequencies being obtained from an impulse response of the low-frequency output speaker disposed in the vibration transmission member, the sine waves having the same frequencies as the resonant frequencies, the audio signal frequency-converted by the frequency conversion unit being outputted from the low-frequency output speaker;

a distortion factor measurement unit configured to obtain a distortion component by removing signal components of the resonant frequencies from signal components of all frequencies of a low-frequency sound, the low-frequency sound being obtained by causing the low-frequency output speaker to output the sine waves having the same frequencies as the resonant frequencies while changing signal levels of the sine waves and then by collecting the sine waves, and to measure a distortion factor of the low-frequency output speaker by calculating a ratio of the signal components of the resonant frequencies to the distortion component in accordance with the changed signal level; and a dynamic range compression unit configured to reduce a signal level of the envelope signal for each of the resonant frequencies on the basis of the distortion factor measured by the distortion factor measurement unit so that a signal level of a low-frequency sound outputted from the low-frequency output speaker becomes equal to or lower than an upper limit of a signal level that can be reproduced by the low-frequency output speaker, the frequency conversion unit frequency-converting the envelope signal whose signal level has been reduced by the dynamic range compression unit.

2. The vibration audio system according to claim 1, wherein the vibration transmission member is a chair on which the listener is seated.

3. A vibration audio output method comprising:

an envelope detection step of, by an envelope detection unit, detecting an envelope signal by obtaining an absolute value of amplitude of an audio signal outputted from a sound source and then integrating the absolute value;

a frequency conversion step of, by a frequency conversion unit, generating an audio signal frequency-converted on the basis of resonant frequencies by multiplying the envelope signal by sine waves, the resonant frequencies being obtained from an impulse response of a low-frequency output speaker disposed in a vibration transmission member configured to allow a listener to perceive vibration of a low-frequency sound, the sine waves having the same frequencies as the resonant frequencies;

an audio signal output step of, by the low-frequency output speaker, outputting the audio signal frequency-converted in the frequency conversion step;

a distortion factor measurement step of, by a distortion factor measurement unit, obtaining a distortion component by removing signal components of the resonant frequencies from signal components of all frequencies of a low-frequency sound, the low-frequency sound being obtained by causing the low-frequency output speaker to output the sine waves having the same frequencies as the resonant frequencies while changing signal levels of the sine waves and then by collecting the sine waves, and measuring a distortion factor of the low-frequency output speaker by calculating a ratio of the signal components of the resonant frequencies to the distortion component in accordance with the changed signal level; and a dynamic range compression step of, by a dynamic range compression unit, reducing a signal level of the envelope signal for each of the resonant frequencies on the basis of the distortion factor measured in the distortion factor measurement step so that a signal level of a low-frequency sound outputted from the low-frequency output speaker becomes equal to or lower than an upper limit of a signal level that can be reproduced by the low-frequency output speaker, wherein in the frequency conversion step, the frequency conversion unit frequency-converts the envelope signal whose signal level has been reduced in the dynamic range compression step.

4. The vibration audio output method according to claim 3, wherein the vibration transmission member is a chair on which the listener is seated.

* * * * *